US010890041B2

(12) United States Patent
Ravi et al.

(10) Patent No.: US 10,890,041 B2
(45) Date of Patent: Jan. 12, 2021

(54) CONTROL SYSTEM FOR MANAGED PRESSURE WELL BORE OPERATIONS

(71) Applicant: Halliburton Energy Services, Inc., Houston, TX (US)

(72) Inventors: Kris Ravi, Kingwood, TX (US); James Randolph Lovorn, Tomball, TX (US); Krishna Babu Yerubandi, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 299 days.

(21) Appl. No.: 15/773,934

(22) PCT Filed: Dec. 31, 2015

(86) PCT No.: PCT/US2015/068230
§ 371 (c)(1),
(2) Date: May 4, 2018

(87) PCT Pub. No.: WO2017/116456
PCT Pub. Date: Jul. 6, 2017

(65) Prior Publication Data

US 2018/0328127 A1 Nov. 15, 2018

(51) Int. Cl.
*E21B 21/08* (2006.01)
*E21B 33/14* (2006.01)

(52) U.S. Cl.
CPC ..... *E21B 21/08* (2013.01); *E21B 33/14* (2013.01)

(58) Field of Classification Search
CPC ..... E21B 21/08; E21B 33/13; E21B 33/14; E21B 33/16
See application file for complete search history.

(56) References Cited

U.S. PATENT DOCUMENTS

2004/0144565 A1* 7/2004 Koederitz ..... E21B 21/08 175/25
2007/0246263 A1 10/2007 Reitsma
(Continued)

OTHER PUBLICATIONS

International Preliminary Report on Patentability issued in related PCT Application No. PCT/US2015/068230 dated Jul. 12, 2018, 12 pages.

(Continued)

*Primary Examiner* — Blake E Michener
(74) *Attorney, Agent, or Firm* — Thomas Rooney; Baker Botts L.L.P.

(57) ABSTRACT

Systems and methods for managed pressure cementing and/or completions operations in subterranean well bores are provided. In some embodiments, the methods comprise: placing a tubular string into a well bore, wherein an outer surface of the tubular string and an inner wall of the well bore define an annulus in a closed pressure loop and in communication with a choke valve; pumping a fluid into the annulus; and while pumping the fluid, determining a setpoint for the choke valve corresponding to a setpoint for a bottomhole pressure in the annulus, determine an actual bottomhole pressure in the annulus using data from a downhole sensor in the annulus, determining if the actual bottomhole pressure is greater than, less than, or equal to the setpoint, and if the actual bottomhole pressure is greater or less than the setpoint, manipulating the choke valve using a controller to decrease or increase the bottomhole pressure.

20 Claims, 3 Drawing Sheets

(56) References Cited

U.S. PATENT DOCUMENTS

| | | | | |
|---|---|---|---|---|
| 2011/0042076 | A1 | 2/2011 | Reitsma | |
| 2012/0103610 | A1* | 5/2012 | Turner | E21B 21/08 166/290 |
| 2012/0285744 | A1 | 11/2012 | Bernard | |
| 2013/0118752 | A1 | 5/2013 | Hannegan et al. | |
| 2014/0238668 | A1 | 8/2014 | Bittleston et al. | |
| 2015/0233198 | A1 | 8/2015 | Leuchtenberg | |
| 2018/0328128 | A1* | 11/2018 | Ravi | E21B 33/14 |

OTHER PUBLICATIONS

International Search Report and Written Opinion issued in related PCT Application No. PCT/US2015/068230 dated Sep. 22, 2016, 15 pages.

* cited by examiner

CONTROL SYSTEM FOR MANAGED PRESSURE WELL BORE OPERATIONS

CROSS-REFERENCE TO RELATED APPLICATION

The present application is a U.S. National Stage Application of PCT Application No. PCT/US2015/068230 filed Dec. 31, 2015, which is incorporated herein by reference in its entirety for all purposes.

BACKGROUND

The present disclosure relates to subterranean operations and, more particularly, to systems and methods for managed pressure operations in subterranean well bores.

Well bores penetrating subterranean zones that contain oil, gas, and/or other fluids typically experience an influx of those fluids into the well bore once they reach the zone containing those fluids. Managed pressure techniques are sometimes employed in drilling and cementing of subterranean well bores in order to control the bottom hole pressure in the well bore at the surface (e.g., to maintain pressure above the pore pressure of the formation), and thus control the influx of formation fluids into the well bore during those operations. Unlike conventional techniques that rely on the density of fluids circulated in the well bore to maintain pressure in the well, managed pressure techniques involve the use of backpressure and maintaining the well bore in a closed pressure loop in order to maintain the desired pressure in the well bore. Most systems for managed pressure drilling include a rotating control device, blowout preventer, and a subsystem of chokes, valves, flow lines, pumps, and other equipment installed at the well site to control the pressure in the well bore and flow of fluids into and out of the well bore.

Precise control of wellbore equipment and systems used in managed pressure operations can be critical to ensure safe and effective operation. For example, maintaining pressure at a level that is higher than the fracturing pressure may cause damage to the formation, while failing to maintain pressure at a level higher than the pore pressure of the formation may allow fluids to flow out of the wellbore prematurely and, in extreme cases, may cause blowouts. Since the pore pressure in the formation and the fracturing pressure of the formation may not differ by a significant amount, maintaining pressure within that narrow window using conventional pressure control equipment may pose significant difficulties. Pressure in the wellbore can also vary significantly based on events in the well, such as influxes of water or other fluids into a formation, movement through various zones of a formation encountered, and the like. Maintaining pressure within the desired window often involves predicting, accounting for, and/or responding to such events substantially in real-time, which may be challenging using conventional pressure control equipment.

BRIEF DESCRIPTION OF THE FIGURES

These drawings illustrate certain aspects of some of the embodiments of the present disclosure, and should not be used to limit or define the disclosure.

Figure 1:
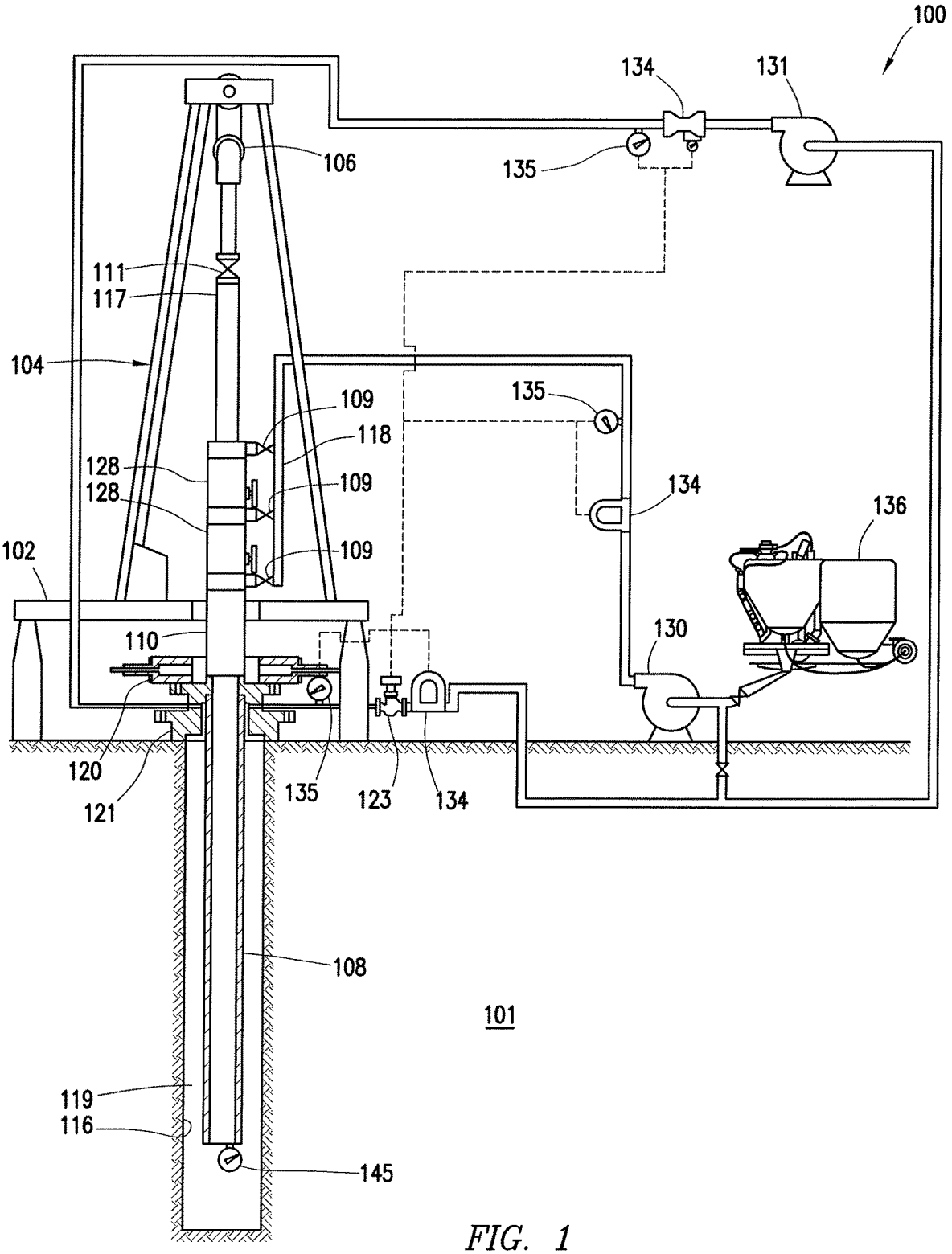
FIG. 1 is a diagram illustrating a well bore operations system according to certain embodiments of the present disclosure.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The present disclosure relates to subterranean operations and, more particularly, to systems and methods for managed pressure operations in subterranean well bores.

In particular, the present disclosure provides systems for automating and improving the control of managed pressure annular cementing (as well as other types of managed pressure well bore operations, other than drilling operations) in a well bore by employing an automated choke control system for maintaining bottomhole pressure in the well bore at (or within a tolerance range of) a set point determined based at least in part on the actual bottomhole pressure measured in the well bore. The systems and methods of the present disclosure use at least one downhole sensor (e.g., a downhole pressure sensor) disposed in the well bore to directly measure bottomhole pressure in the well bore during a well bore operation. That information is provided to an information handling system that automatically analyzes that data (and optionally other data from sensors in the system) to measure or otherwise determine the actual bottomhole pressure, and communicates signals to an electronic control for the choke valve (and any other associated equipment at the well site) to adjust or maintain the bottomhole pressure at the desired setpoint. In certain embodiments, the information handling system uses data from the downhole sensor, and optionally other sensors in the system, to create computerized models for the well bore operation being performed in or near real-time, calculate a setpoint for the choke valve corresponding to a setpoint for the bottomhole pressure based on that model, and/or automatically communicate signals to an electronic control for the choke valve (and any other associated equipment at the well site) to adjust or maintain the bottomhole pressure at the desired or calculated setpoint.

The systems and methods of the present disclosure may, among other benefits, provide for more effective and accurate monitoring and control of managed pressure cementing and completions operations. For example, by automating certain aspects of controlling equipment in these operations, the systems and methods of the present disclosure may facilitate quicker and more reliable detection of and/or response to well bore events (e.g., failures, influxes of fluids, etc.) during a managed pressure cementing or completions operation. The real-time data measurement and computational modeling used in certain embodiments of the present disclosure also may be able to accommodate different types of variables present in managed pressure cementing and/or completions operations that are not present managed pressure drilling operations, including but not limited to the different types of fluids, fluid flow (e.g., free-fall), well bore geometries, casing geometries, and other variables not encountered in managed pressure drilling operations. In certain embodiments, the systems of the present disclosure may be able to accommodate higher well bore pressures and/or well bore equipment of nonstandard dimensions, for example, by eliminating certain pressure-limiting or size-limiting equipment such as rotating control devices that are not needed for managed pressure cementing or completions operations.

FIG. 1 illustrates a system 100 according to certain embodiments of the present disclosure for performing managed pressure cementing operations involving the cementing of a casing string in a well bore 116 that penetrates a portion of a subterranean formation 101. It should be noted that while FIG. 1 generally depicts a land-based system, those skilled in the art will readily recognize that the principles described herein are equally applicable to subsea operations that employ floating or sea-based platforms and rigs, without departing from the scope of the disclosure. As illustrated, the system 100 may include a platform 102 that supports a derrick 104 having a traveling block 106 for raising and lowering casings, liners, production tubing, drill strings, work strings, and other tubulars or equipment into the well bore 116. Casing string 108 may comprise one or more individual casing joints connected together, as well as other equipment for placing the casing in the well bore (e.g., a shoe, float collar, centralizers, etc.). A casing adapter 110, kelly 111, and spool 117 supports the casing string 108 as it is lowered through an opening in the floor of the platform 102. Although not shown, one or more other casing strings (e.g., surface casing) already may be disposed and/or cemented in well bore 116 uphole of casing string 108.

The system 100 further comprises a blowout preventer (BOP) 120 and a variable choke valve 123, which may be connected to the well bore 116 at wellhead 121. A housing of the BOP 120 may be connected to wellhead 121, such as by a flanged connection. In some embodiments, the BOP housing may also be connected (e.g., by a flanged connection) to a housing of a rotating control device RCD (not shown) into which the casing adapter 110 is inserted. Such RCDs may include a stripper seal for rotation of a casing string or other work string relative to the RCD housing by bearings. Alternatively, in certain embodiments, the RCD may be omitted from system 100 (or removed from a system used to drill well bore 116) and a packer or BOP may be used to form a seal with the casing adapter 110 instead. Omission or removal of the RCD may, among other benefits, allow the system to accommodate pressures higher than the maximum pressure for most RCDs known in the art.

The choke 123 may be connected to an outlet port (not shown) of the wellhead 121, and may be fortified to operate in an environment where return fluid therethrough may include solids. The choke 123 may include one or more isolation valves that are operable by a controller (not shown) (e.g., an electronic controller, a pneumatic controller, a hydraulic controller, etc.) to maintain backpressure in the wellhead 121 at a particular setpoint determined by an information handling system, as described in further detail below.

System 100 may further comprise a cement mixer 136 (such as a recirculating mixer) and a cementing pump 130 connected to a multi-branch cementing manifold 118. Each branch may include a shutoff valve 109 for providing selective fluid communication between the main line of the manifold 118 and one or more plug launchers 128. Each launcher 128 may include a canister for housing a respective cementing plug and retainer valve or latch operable to selectively retain the respective wiper in the launcher. A lower branch of the manifold 118 may connect the manifold trunk directly to the casing adapter 110, thereby bypassing the launchers 128.

System 100 also may further comprise an annulus pump 131, one or more flow meters 134 and one or more pressure sensors 135. For example, the pressure sensor 135 connected between the choke 123 and the wellhead 121 (or at the choke 123) may be operable to monitor wellhead pressure. The pressure sensor 135 connected between an annulus pump 131 and the wellhead 121 and may be operable to monitor a discharge pressure of the annulus pump. The pressure sensor 135 connected between a cement pump 130 and the cementing manifold 118 and may be operable to monitor manifold pressure. The flow meters 134 may each be a mass flow meter, such as a Coriolis flow meter. The cement flow meter 135 connected between the cement pump 130 and the cementing manifold 118 and may be operable to monitor a flow rate of the cement pump. The flow meter 134 connected between the choke 123 and the annulus pump 131 and may be operable to monitor a flow rate of return fluid. The flow meter 34 connected between the annulus pump 130 and the wellhead 121 may be a volumetric flow meter, such as a Venturi flow meter and may be operable to monitor a flow rate of the annulus pump. System 100 also comprises at least one downhole sensor such as downhole pressure sensor 145, which may comprise any known pressure sensor in the art (including but not limited to piezoresistive sensors, piezoelectric sensors, capacitive sensors, fiber optic sensors, and the like), and may be installed on the casing string 108 or run into the well bore 116 on a wireline or other work string. Pressure sensor 145 thus may be able to directly monitor the bottomhole pressure in well bore 116. Alternatively, in some embodiments, downhole pressure sensor 145 could be replaced with other types of downhole sensors that are used to measure other downhole conditions (e.g., temperature, fluid density, fluid flow rate, heat capacity, fluid viscosity, etc.) that are used to calculate the bottomhole pressure in well bore 116. Additional downhole sensors such as pH sensors, temperature sensors, density sensors, heat capacity sensors, conductivity recorders, chemical sensors, radio frequency (RF) sensors, electromagnetic (EM) sensors, acoustic sensors, and the like may be installed in well bore 116 to directly monitor various conditions and phenomena in the well bore 116.

Each of flow meters 134, pressure sensors 135, and downhole pressure sensor 145 (as well as other downhole sensors not specifically shown in FIG. 1) may be in data communication with an information handling system (not shown). Choke 123 and the valves in manifold 118 (as well as other valves in the system not specifically shown in FIG. 1) may be communicatively coupled to a controller, which may be in data communication with information handling system. These components may transmit data regarding pressure, fluid flow rates, and/or other conditions in various places in the system 100 and/or well bore 116 to the information handling system, which may use that data to model conditions and/or determine setpoints for the choke valve and/or bottomhole pressure for an ongoing managed pressure cementing operation, as described in further detail below.

To stabilize the casing string 108 in the well bore 116, a cement fluid or slurry may be mixed in the cement mixer 136 and pumped by pump 130 to the cementing manifold 118, downwardly through the bottom of casing string 108, and then upwardly into an annulus 119 formed between the casing 108 and the walls of the well bore 116. In certain embodiments, a cementing fluid of the present disclosure may comprise a base fluid and one or more cementitious materials (e.g., Portland cements, fly ash, pozzolanic cements, gypsum cements, high alumina content cements, silica cements, etc.), and one or more other additives used to impart desired properties to the cement (e.g., set retarders, strengthening additives, and the like). In the embodiments of the present disclosure, the annulus is "closed" or a part of a "closed pressure loop" in that it does not communicate with the surface but is instead closed by an isolation device, which may include one or more of the RCD, a BOP, a packer, or other suitable device. Wiper plugs may be released into the well bore 116 prior to and/or after pumping the cement fluid into the well bore 116, among other reasons, to displace drilling fluid, cement fluid, spacer fluids, or other treatment fluids downhole. Once placed in the annulus, the cement composition is permitted to set therein, thereby forming an annular sheath of hardened, substantially impermeable cement that substantially supports and positions the casing in the well bore and bonds the exterior surface of the casing to the interior wall of the well bore. Once the cement sets, it holds the casing in place, facilitating performance of subterranean operations.

In the methods and systems of the present disclosure, an information handling system is used to automatically control the choke valves at the well site based at least in part on the bottomhole pressure measured in the annulus. The information handling system is communicatively coupled to an electronic controller that controls the operation of the choke valve(s) at the well. The information handling systems of the present disclosure may be configured to receive and process data from sensors in a well bore system (e.g., a downhole pressure sensor) and other data sources to perform a number of functions. For example, the information handling system may use such data to monitor whether a bottomhole pressure or other conditions in a well bore are at (or within acceptable variances of) a setpoint, select or calculate a setpoint for the choke valve and/or bottomhole pressure in the well bore for a managed pressure operation based on that data, incorporate that data into a computational model for a downhole operation, and/or other related functions. The information handling systems of the present disclosure may be further configured to send electrical signals to one or more electronic controllers coupled to various pieces of equipment in a well bore operation system (e.g., choke valves, BOPs, RCDs, pumps, etc.) to automate their operation.

Figure 2:
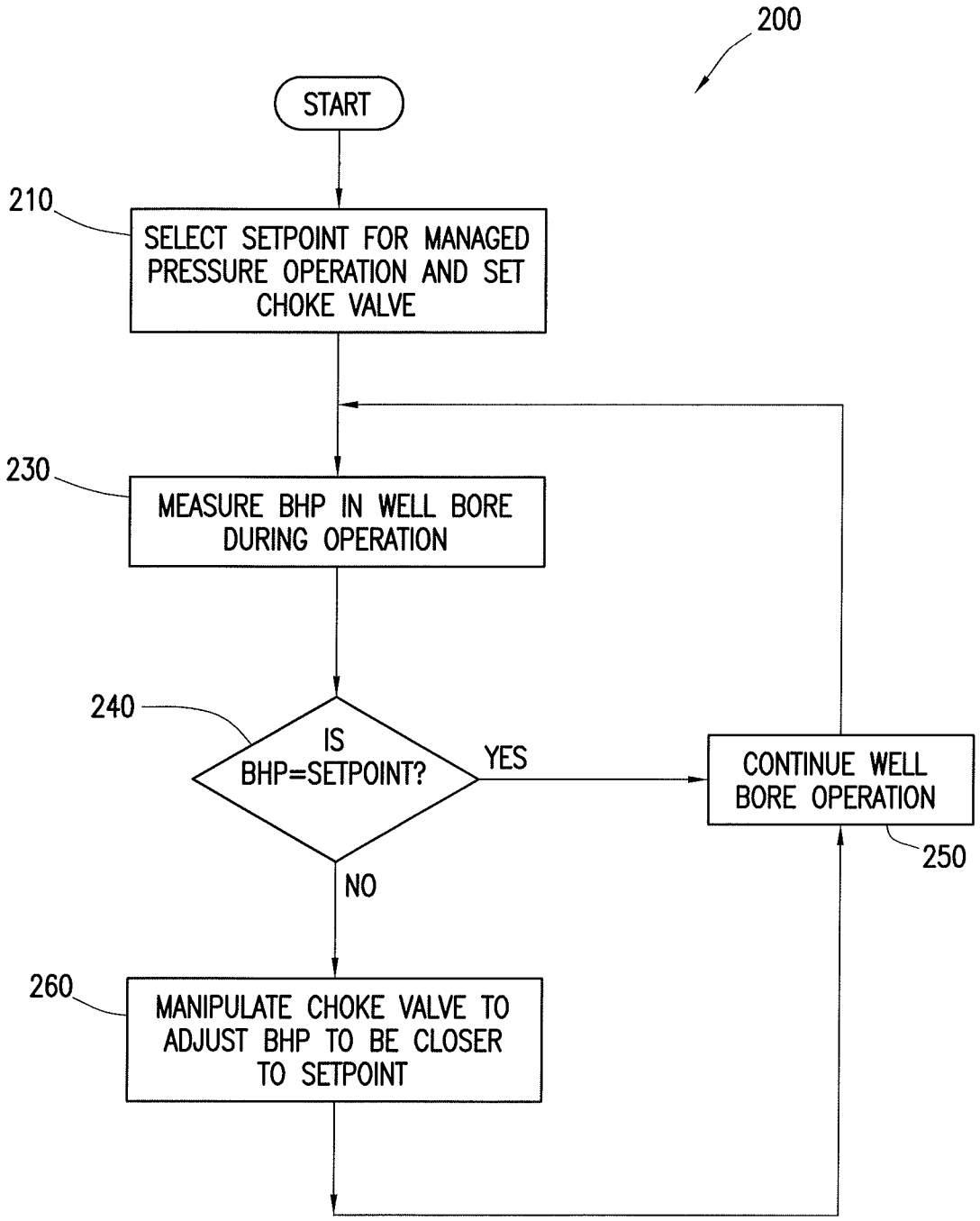
FIG. 2 is a flowchart illustrating certain aspects of methods for performing managed pressure well bore operations according to certain embodiments of the present disclosure.

Certain embodiments of the methods of the present disclosure are illustrated in the flowchart provided in FIG. 2. The process 200 shown in FIG. 2 may be used in the performance of any managed pressure cementing or completions operation, and may be performed in whole or in part by an information handling system as described above. At the start of the operation, a setpoint for the choke valve for the managed pressure operation is selected at step 210 and the choke valve may be set to maintain that setpoint, and the cementing or completion fluids for the operation may be pumped into the well bore. In certain embodiments, this setpoint may be determined by the operator, an information handling system, or any other suitable source, and may be determined prior to or during the performance of the managed pressure operation itself. In certain embodiments, the setpoint may be determined by referencing a lookup table in the literature listing proposed setpoints for certain types of operations, formations, or other parameters. In other embodiments, the setpoint may be determined with reference to a computational model created or modified by the information handling system, as described in further detail below. At step 230, a downhole pressure sensor measures the actual bottomhole pressure in the well bore (e.g., in the annulus of a well bore where a casing string resides) and communicates that data to the information handling system. At step 240, the information handling system determines whether the actual bottomhole pressure measured in the well bore is equal to the setpoint for the bottomhole pressure. If so, the well bore operation may be continued at step 250 at the current settings until the next BHP measurement is made. If the actual BHP in the well bore is not equal to the setpoint, at step 260 the information handling system may send one or more signals to an electronic controller that controls the operation of the choke valve (and optionally other equipment being used in the well bore operation) to increase or decrease the BHP as needed to approach the desired setpoint. Once the adjustment is made, the well bore operation may continue at step 250 until the next BHP measurement is made.

With the input of bottomhole pressure as measured or otherwise determined by the downhole sensors, the information handling system can also create and/or modify a computational fluid dynamics model in real-time for the hydrodynamic state of the well during a particular well bore operation, which may be used to set parameters for the automatic operation of the choke (and optionally other equipment) during the managed pressure well bore operation. For example, in certain embodiments, the information handling system may create a computerized model for predicting various properties or conditions in a cementing or completion operation (including but not limited to compressive strength, rheological properties, height, and/or bonding of the cement, equivalent circulating density of a fluid, etc.) at the existing setpoint and/or bottomhole pressure as well as any number of other possible setpoints and/or bottomhole pressures for the well. Based on those models and the desired properties of the cement or completion, a system of the present disclosure may automatically manipulate the chokes and/or other equipment to cause the bottomhole pressure to match the previously-selected setpoint or a new setpoint for bottomhole pressure in the well bore based at least in part on the computational model. In certain embodiments, the desired setpoint for bottomhole pressure during the operation may be calculated or re-calculated by the information handling system (using the computational model as well as other data measured in the system) to account for certain events occurring in the well bore such as kicks, production of fluids, changes in composition of formation fluids, fluid leakage, or other changes to conditions in the well bore. In certain embodiments, the information handling system also may be configured to shut down all or part of the operation in response to pressure conditions or other conditions indicating certain types of dangerous or unanticipated well bore events.

The computerized model for the hydrodynamic state of a well bore in a closed pressure loop during a subterranean operation of the present disclosure may be generated with real-time data regarding flow rate, fluid density, fluid rheology, back pressure, wellbore geometry, or any combination thereof, and then correlated with real-time measurement of surface pressure and bottomhole pressure. The hydrodynamic state of the well bore at any given time may be defined by the fluid concentrations, flow rates/velocities, and pressure in the wellbore (as a function of length, or 3 spatial dimensions). In other words, the hydrodynamic state of the well bore at time n+1 is a function of the following:

1. Hydrodynamic state of the well bore at time n;
2. Pumping Rate/Flow Rate of the fluid in the well bore;
3. Density of the incoming fluid into the well bore;
4. Rheology of the incoming fluid into the well bore
5. Wellbore geometry; and
6. Back Pressure applied to the well bore.

Computer models may be generated to estimate back pressure (which may be used as a setpoint to control the choke valve) required at time n+1 to keep the bottomhole pressure in the well bore within the pore pressure and fracture gradient tolerance of the subterranean formation. This is done by iterative generating future models for range of back pressures to arrive at a set point for the back pressure controlled at the choke valve. In some embodiments, models correlated to real-time sensor measured downhole pressure can indicate losses, driving to the models to use additional safety margins to the pore pressure and fracture gradient window for the formation.

Such models may be generated by using a series of equations to calculate various values for the hydrodynamic state of the well bore based on realtime data measured in the well bore. An example of a set of equations for velocity and pressure (continuity and momentum) of fluid flow in the formation may be provided by Equations (1)-(4) below.

$$\frac{\partial \rho}{\partial t} = \frac{\partial(\rho v_x)}{\partial x} + \frac{\partial(\rho v_y)}{\partial y} + \frac{\partial(\rho v_z)}{\partial z} \tag{1}$$

$$\frac{\partial(\rho v_x)}{\partial t} + \frac{\partial(\rho v_x v_x)}{\partial x} + \frac{\partial(\rho v_y v_x)}{\partial y} + \frac{\partial(\rho v_z v_x)}{\partial z} = -\left[\frac{\partial \tau_{xx}}{\partial x} + \frac{\partial \tau_{yx}}{\partial y} + \frac{\partial \tau_{zx}}{\partial z}\right] - \frac{\partial P}{\partial x} + \rho g_x \tag{2}$$

$$\frac{\partial(\rho v_y)}{\partial t} + \frac{\partial(\rho v_x v_y)}{\partial x} + \frac{\partial(\rho v_y v_y)}{\partial y} + \frac{\partial(\rho v_z v_y)}{\partial z} = -\left[\frac{\partial \tau_{xy}}{\partial x} + \frac{\partial \tau_{yy}}{\partial y} + \frac{\partial \tau_{zy}}{\partial z}\right] - \frac{\partial P}{\partial y} + \rho g_y \tag{3}$$

$$\frac{\partial(\rho v_y)}{\partial t} + \frac{\partial(\rho v_x v_y)}{\partial x} + \frac{\partial(\rho v_y v_y)}{\partial y} + \frac{\partial(\rho v_z v_y)}{\partial z} = -\left[\frac{\partial \tau_{xz}}{\partial x} + \frac{\partial \tau_{yz}}{\partial y} + \frac{\partial \tau_{zz}}{\partial z}\right] - \frac{\partial P}{\partial y} + \rho g_z \tag{4}$$

In Equations (1)-(4) above, ρ is the density of the fluid, $v_x, v_y, v_z$ are the velocities in x,y,z directions respectively, P is the pressure, and $g_x$ is the gravitational constant, $\tau_{ij}$ is the stress tensor in ij direction where i,j can take all the three directions x,y,z. Stress tensor is related to fluid velocities and the relationship is defined the rheology of the fluid. Fluid concentration may be given by Equation (5) below.

$$\frac{\partial(c_i)}{\partial t} + \frac{\partial(c_i v_x)}{\partial x} + \frac{\partial(c_i v_y)}{\partial y} + \frac{\partial(c_i z)}{\partial z} = D\left[\frac{\partial^2 c_i}{\partial x^2} + \frac{\partial^2 c_i}{\partial y^2} + \frac{\partial^2 c_i}{\partial y^2}\right] + S \tag{5}$$

In Equation (5), $c_i$ is the concentration of the fluid, D is the diffusivity of the fluid, and S is the source term to account for fluid losses in the wellbore due to lost circulation. The above equations in 3 dimensions (or simplified equations in lesser dimensions) may be solved numerically to estimate the hydrodynamic state of the well bore at any given time using Pumping Rate, Back Pressure, Density of the incoming fluid as boundary conditions and Rheology as input the momentum equations. An appropriate setpoint for the desired bottomhole pressure (and corresponding setpoint for the choke valve) may be selected based on the hydrodynamic state of the well bore and the estimated pore pressure/fracture gradient of the formation.

For example, a simplified momentum balance equation (e.g., based on Equations (2), (3), and (4) above) for 1-dimensional system would give rise to Equation (6) below.

$$-\frac{dP}{dz} + \rho g_x = \frac{dP}{dz_{friction}} + \frac{dP}{dz_{surge/swab}} \tag{6}$$

Integrating this expression yields Equation (7) below, which can be used to calculate bottomhole pressure (BHP) based applied back pressure and the wellbore conditions.

$$\text{BHP}=(\text{Back Pressure})+(\text{Hydrostatic Pressure})+(\text{Surge/Swab Pressure})+(\text{Friction Pressure}) \tag{7}$$

The required choke valve set point for the back pressure calculated above can be calculated by iteratively executing Equation (7) and identifying the Back Pressure that gives a BHP within pore pressure and fracture gradient. A person of skill in the art with the benefit of this disclosure will recognize other methods that may be used to calculate the setpoint using data available in a particular method or system of the present disclosure.

Figure 3:
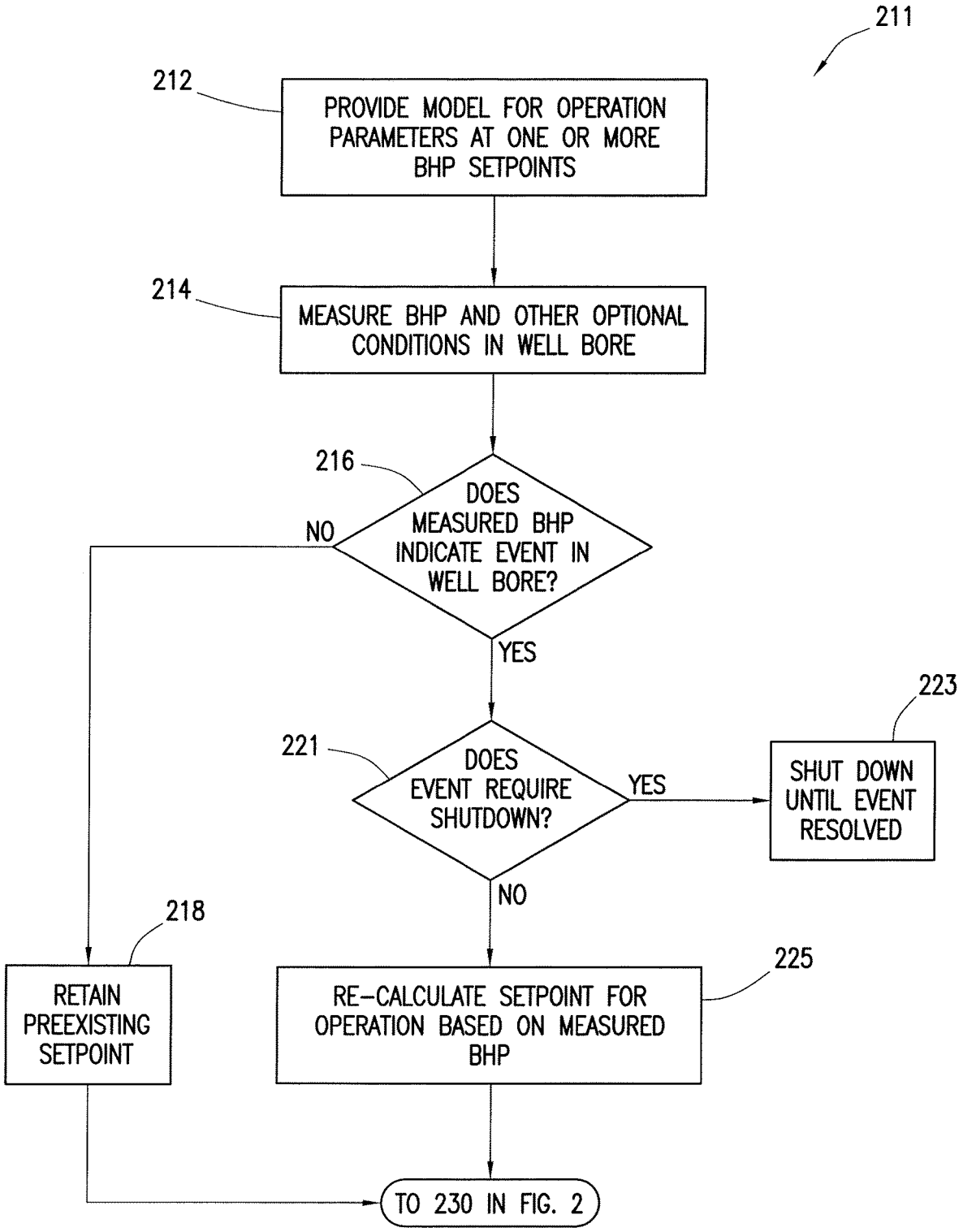
FIG. 3 is a flowchart illustrating certain aspects of methods for performing managed pressure well bore operations according to certain embodiments of the present disclosure.

FIG. 3 is a flowchart illustrating certain aspects of these processes in certain methods and systems of the present disclosure. The process 211 shown in FIG. 3 is one example of a process by which the setpoint for a managed pressure operation may be selected in step 210 of the process 200 shown in FIG. 2, and thus may be performed as a subprocess in process 200. Referring now to FIG. 3, at step 211, an initial model for predicting one or more properties or conditions in a cementing or completion operation (including but not limited to compressive strength, rheological properties, height, and/or bonding of the cement, equivalent circulating density of a fluid, etc.) at one or more setpoints may be provided in the information handling system. At step 214, a downhole pressure sensor measures the actual bottomhole pressure in the well bore (e.g., in the annulus of a well bore where a casing string resides) and communicates that data to the information handling system. At step 216, the information handling system may compare the actual BHP measured in the well bore to the expected BHP based on the computational model. If the actual BHP is within an acceptable range of variance from the expected BHP in the model, the existing setpoint for the operation may remain set at step 218, and the operation may continue with that setpoint (e.g., in the process shown in FIG. 2). If the actual BHP differs substantially from the expected BHP in the model, this may indicate that one or more unanticipated events may have occurred in the well bore, which may require one or more remedial steps or adjustments in the operation.

At step 221, the information handling system may use the magnitude of the difference between the actual BHP measured in the well bore to the expected BHP to determine if the well bore event is significant or dangerous enough to require shutdown of the system based on predetermined definitions or parameters. If the information handling system determines that the event requires shutdown, at step 223, the information handling system may send signals to one or more electronic controllers in the system controlling the operation of various pieces of equipment in the system to shut in the well and/or suspend further operations until the conditions triggering the shutdown are resolved or an operator manually resumes operations. By allowing the information handling system to monitor pressure data and automatically shut down the well bore equipment based on that data, the methods and systems of the present disclosure may facilitate faster and/or more reliable responses when failures or other problems are indicated by those tests.

If the information handling system determines that the event does not satisfy predetermined definitions or parameters that require shutdown, at step 225, the information handling system may use the actual BHP measured in the well to re-calculate or select a new setpoint for the managed pressure operation that takes into account the variance from the model due to the detected event, and set the choke valve to continue with the managed pressure operation at that setpoint (e.g., in the process shown in FIG. 2). This process may be repeated at one or more points during the course of a particular managed pressure operation at any desired points or frequency.

Although FIGS. 1-3 and other portions of this disclosure have described managed pressure cementing operations, similar equipment and methods may be applies to other managed pressure completion operations in subterranean well bores where the well bore is maintained in a "closed" configuration such that bottomhole pressure can be controlled at the surface. Such completion operations may involve the placement of packers, production tubing, and/or any other equipment in the well to prepare the well for production.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer or tablet device, a cellular telephone, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more devices for reading storage media, one or more network ports for communication with external devices as well as various input and output (I/O) devices, such as a keyboard, a mouse, and a video display. The information handling system may also include one or more buses operable to transmit communications between the various hardware components. As would be appreciated by those of ordinary skill in the art, with the benefit of this disclosure, the information handling system may be communicatively coupled to the components through wired or wireless connections to facilitate data transmission to or from other components of the system. The information handling system used in the embodiments of the present disclosure may be located at the well site or, alternatively, may be provided at a remote location. When the information handling system is remotely located, it may communicate with the electronic controller for the choke system and/or the downhole pressure sensor (as well as any other optional sensors in the system) via an external communications interface installed at the well site. The external communications interface may be connected to and permit an information handling system at a remote location communicatively coupled to the external communications interface via, for example, a satellite, a modem or wireless connections to send signals to and/or receive signals from one or more components at the well site. In certain embodiments, the external communications interface may include a router.

Any suitable processing application software package may be used by the information handling to process the data from the downhole pressure sensor and other optional sensors in the system. In one embodiment, the software produces data that may be presented to the operation personnel in a variety of visual display presentations such as a display. In certain example system, the measured value set of parameters, the expected value set of parameters, or both may be displayed to the operator using the display. For example, the measured-value set of parameters may be juxtaposed to the expected-value set of parameters using the display, allowing the user to manually identify, characterize, or locate a downhole condition. The sets may be presented to the user in a graphical format (e.g., a chart) or in a textual format (e.g., a table of values). In another example system, the display may show warnings or other information to the operator when the central monitoring system detects a downhole condition. Suitable information handling systems and software packages may include those used in the iCem® service or the GeoBalance® Managed Pressure Drilling service provided by Halliburton Energy Services, Inc. In certain embodiments, the software package may be provided to an information handling system via programming into the hardware of that system, via computer-readable media, or a combination thereof.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The terms "couple" or "couples," as used herein are intended to mean either an indirect or a direct connection. Thus, if a first device couples to a second device, that connection may be through a direct connection, or through an indirect electrical connection via other devices and connections. The term "communicatively coupled" as used herein is intended to mean coupling of components in a way to permit communication of information therebetween. Two components may be communicatively coupled through a wired or wireless communication network, including but not limited to Ethernet, LAN, fiber optics, radio, microwaves, satellite, and the like. Operation and use of such communication networks is well known to those of ordinary skill in the art and will, therefore, not be discussed in detail herein.

It will be understood that the term "oil well cementing equipment" or "oil well cementing system" is not intended to limit the use of the equipment and processes described with those terms to cementing in an oil well. The terms also encompass cementing or other operations natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons.

An embodiment of the present disclosure is a method comprising: placing a tubular casing string into a well bore penetrating at least a portion of a subterranean formation, wherein an outer surface of the casing string and an inner wall of the well bore define an annulus in a closed pressure loop and in communication with at least one choke valve that is coupled to a controller; pumping a cementing fluid through the inside of the tubular casing string and into the annulus in the well bore; and while pumping the cementing fluid into the annulus in the well bore: determining a setpoint for the choke valve corresponding to a setpoint for a bottomhole pressure in the annulus, determining an actual bottomhole pressure in the annulus using data from at least one downhole sensor disposed in the annulus, determining if the actual bottomhole pressure in the annulus is greater than, less than, or equal to the setpoint for the bottomhole pressure in the annulus, and if the actual bottomhole pressure in the annulus is greater or less than the setpoint for the bottomhole pressure in the annulus, manipulating the choke valve using the controller to decrease or increase the bottomhole pressure in the annulus.

Another embodiment of the present disclosure is a method for performing a completions operation in a well bore penetrating at least a portion of a subterranean formation, the method comprising: placing a tubular string into the well bore, wherein an outer surface of the tubular string and an inner wall of the well bore define an annulus in a closed pressure loop and in communication with at least one choke valve that is coupled to a controller; pumping a completion fluid into the annulus in the well bore; and while pumping the completion fluid into the annulus in the well bore: determining a setpoint for the choke valve corresponding to a setpoint for a bottomhole pressure in the annulus, determining an actual bottomhole pressure in the annulus using data from at least one downhole sensor disposed in the annulus, determining if the actual bottomhole pressure in the annulus is greater than, less than, or equal to the setpoint for the bottomhole pressure in the annulus, and if the actual bottomhole pressure in the annulus is greater or less than the setpoint for the bottomhole pressure in the annulus, manipulating the choke valve using the controller to decrease or increase the bottomhole pressure in the annulus.

Another embodiment of the present disclosure is a system for use in a cementing or completion operation in a well bore penetrating at least a portion of a subterranean formation, the system comprising: an isolation device disposed at the well bore that closes an annulus defined by an outer surface of a tubular string disposed in the well bore and an inner wall of the well bore; at least one choke valve in communication with the annulus; a controller coupled to and configured to manipulate the choke valve; one or more pumps in communication with the annulus in the well bore; a downhole sensor disposed in the annulus; and an information handling system communicatively coupled to the controller and the downhole sensor, the information handling system being configured to: determine a setpoint for the choke valve corresponding to a setpoint for a bottomhole pressure in the annulus, receive data relating to an actual bottomhole pressure in the annulus from the downhole sensor, determine if the actual bottomhole pressure in the annulus is greater than, less than, or equal to the setpoint for the bottomhole pressure in the annulus, and if the actual bottomhole pressure in the annulus is greater or less than the setpoint for the bottomhole pressure in the annulus, send one or more signals to the controller to manipulate the choke valve to decrease or increase the bottomhole pressure in the annulus.

Therefore, the present disclosure is well-adapted to carry out the objects and attain the ends and advantages mentioned as well as those which are inherent therein. While the disclosure has been depicted and described by reference to exemplary embodiments of the disclosure, such a reference does not imply a limitation on the disclosure, and no such limitation is to be inferred. The disclosure is capable of considerable modification, alteration, and equivalents in form and function, as will occur to those ordinarily skilled in the pertinent arts and having the benefit of this disclosure. The depicted and described embodiments of the disclosure are exemplary only, and are not exhaustive of the scope of the disclosure. The terms in the claims have their plain, ordinary meaning unless otherwise explicitly and clearly defined by the patentee.

What is claimed is:

1. A method comprising:

placing a tubular casing string into a well bore penetrating at least a portion of a subterranean formation, wherein an outer surface of the casing string and an inner wall of the well bore define an annulus in a closed pressure loop and in communication with at least one choke valve that is coupled to a controller;

pumping a cementing fluid through the inside of the tubular casing string and into the annulus in the well bore; and while pumping the cementing fluid into the annulus in the well bore:

determining a setpoint for the choke valve corresponding to a setpoint for a bottomhole pressure in the annulus, wherein determining the setpoint for the choke valve comprises using an information handling system to generate or update a model of one or more conditions in the well bore that includes at least the setpoint for the bottomhole pressure in the annulus, wherein the model calculates and outputs the setpoint for the choke valve, determining an actual bottomhole pressure in the annulus using data from at least one downhole sensor disposed in the annulus, determining, via the information handling system, if the actual bottomhole pressure in the annulus is greater than, less than, or equal to the setpoint for the bottomhole pressure in the annulus, and if the actual bottomhole pressure in the annulus is greater or less than the setpoint for the bottomhole pressure in the annulus, manipulating the choke valve using the controller to decrease or increase the bottomhole pressure in the annulus, wherein manipulating the choke valve comprises causing the information handling system to send one or more signals to the controller for manipulating the choke valve.

2. The method of claim 1 further comprising allowing the cementing fluid to at least partially set in the annulus.

3. The method of claim 1 wherein the closed pressure loop is maintained by an isolation device disposed at the well bore, the isolation device selected from the group consisting of: a rotating control device, a blow-out preventer, a packer, and any combination thereof.

4. The method of claim 1 wherein the closed pressure loop is maintained by an isolation device disposed at the well bore, wherein the isolation device does not comprise a rotating control device.

5. The method of claim 1 wherein the downhole sensor comprises a downhole pressure sensor.

6. The method of claim 1 wherein the controller comprises an electronic controller.

7. The method of claim 1, wherein the model of the one or more conditions in the well bore further includes a hydrostatic pressure, a surge/swab pressure, and a friction pressure.

8. The method of claim 7, wherein the model of the one or more conditions in the well bore is generated by solving numerical equations to estimate a hydrodynamic state of the well bore based on a pumping rate, density of incoming fluid, and rheology.

9. The method of claim 1, wherein determining the setpoint for the choke valve comprises using the information handling system to generate or update the model of one or more conditions in the well bore that includes at least the setpoint for the bottomhole pressure in the annulus and the actual bottomhole pressure as inputs.

10. A method for performing a completions operation in a well bore penetrating at least a portion of a subterranean formation, the method comprising:

placing a tubular string into the well bore, wherein an outer surface of the tubular string and an inner wall of the well bore define an annulus in a closed pressure loop and in communication with at least one choke valve that is coupled to a controller;

pumping a completion fluid into the annulus in the well bore; and while pumping the completion fluid into the annulus in the well bore:

determining a setpoint for the choke valve corresponding to a setpoint for a bottomhole pressure in the annulus, wherein determining the setpoint for the choke valve comprises using an information handling system to generate or update a model of one or more conditions in the well bore that includes at least the setpoint for the bottomhole pressure in the annulus, wherein the model calculates and outputs the setpoint for the choke valve, determining an actual bottomhole pressure in the annulus using data from at least one downhole sensor disposed in the annulus, determining, via the information handling system, if the actual bottomhole pressure in the annulus is greater than, less than, or equal to the setpoint for the bottomhole pressure in the annulus, and if the actual bottomhole pressure in the annulus is greater or less than the setpoint for the bottomhole pressure in the annulus, manipulating the choke valve using the controller to decrease or increase the bottomhole pressure in the annulus, wherein manipulating the choke valve comprises causing the information handling system to send one or more signals to the controller for manipulating the choke valve.

11. The method of claim 10, wherein determining the setpoint for the choke valve comprises using the information handling system to generate or update the model of one or more conditions in the well bore that includes at least the setpoint for the bottomhole pressure in the annulus and the actual bottomhole pressure as inputs.

12. The method of claim 10 wherein the closed pressure loop is maintained by an isolation device disposed at the well bore, the isolation device selected from the group consisting of: a rotating control device, a blow-out preventer, a packer, and any combination thereof.

13. The method of claim 11 wherein the closed pressure loop is maintained by an isolation device disposed at the well bore, wherein the isolation device does not comprise a rotating control device.

14. The method of claim 11 wherein the downhole sensor comprises a downhole pressure sensor.

15. The method of claim 11, wherein the model of the one or more conditions in the well bore further includes a hydrostatic pressure, a surge/swab pressure, and a friction pressure.

16. The method of claim 15, wherein the model of the one or more conditions in the well bore is generated by solving numerical equations to estimate a hydrodynamic state of the well bore based on a pumping rate, density of incoming fluid, and rheology.

17. A system for use in a cementing or completion operation in a well bore penetrating at least a portion of a subterranean formation, the system comprising:

an isolation device disposed at the well bore that closes an annulus defined by an outer surface of a tubular string disposed in the well bore and an inner wall of the well bore;

at least one choke valve in communication with the annulus;

a controller coupled to and configured to manipulate the choke valve;

one or more pumps in communication with the annulus in the well bore;

a downhole sensor disposed in the annulus; and an information handling system communicatively coupled to the controller and the downhole sensor, the information handling system being configured to:

determine a setpoint for the choke valve corresponding to a setpoint for a bottomhole pressure in the annulus by generating or updating a model of one or more conditions in the well bore that includes at least the setpoint for the bottomhole pressure in the annulus, wherein the model calculates and outputs the setpoint for the choke valve, receive data relating to an actual bottomhole pressure in the annulus from the downhole sensor, determine if the actual bottomhole pressure in the annulus is greater than, less than, or equal to the setpoint for the bottomhole pressure in the annulus, and if the actual bottomhole pressure in the annulus is greater or less than the setpoint for the bottomhole pressure in the annulus, send one or more signals to the controller to manipulate the choke valve to decrease or increase the bottomhole pressure in the annulus.

18. The system of claim 17 wherein the isolation device comprises at least one apparatus selected from the group consisting of: a rotating control device, a blow-out preventer, a packer, and any combination thereof.

19. The system of claim 17 wherein the isolation device does not comprise a rotating control device.

20. The system of claim 17 wherein the downhole sensor comprises a downhole pressure sensor.

* * * * *